US006354224B1

(12) United States Patent
Devnani et al.

(10) Patent No.: US 6,354,224 B1
(45) Date of Patent: Mar. 12, 2002

(54) CONVEYOR SYSTEM SWITCH USING TUBULAR LINEAR INDUCTION MOTOR

(75) Inventors: Deepak Devnani, Waterford; Edward E. Ball, Livonia, both of MI (US)

(73) Assignee: Jervis B. Webb Company, Farmington Hills, MI (US)

( * ) Notice: Subject to any disclaimer, the term of this patent is extended or adjusted under 35 U.S.C. 154(b) by 0 days.

(21) Appl. No.: 09/564,810

(22) Filed: May 5, 2000

Related U.S. Application Data

(60) Provisional application No. 60/132,802, filed on May 6, 1999.

(51) Int. Cl.[7] ..... E01B 25/26

(52) U.S. Cl. ..... 104/130.01; 104/130.03; 104/130.06; 104/96; 104/102

(58) Field of Search ..... 104/130.01, 130.03, 104/130.06, 96, 102, 104, 105, 130.11; 246/225, 226, 227, 231, 253

(56) References Cited

U.S. PATENT DOCUMENTS

| | | | | |
|---|---|---|---|---|
| 3,347,171 A | | 10/1967 | Torrance | |
| 3,434,431 A | | 3/1969 | Dehne | |
| 3,464,364 A | * | 9/1969 | Dehne | 104/96 |
| 3,477,390 A | | 11/1969 | Dolding | |
| 3,760,739 A | | 9/1973 | Benner | 104/130.01 |
| 3,799,436 A | | 3/1974 | Frasure | |
| 3,800,710 A | | 4/1974 | Raoulx | |
| 3,835,785 A | * | 9/1974 | Kirschner et al. | 104/130.01 |
| 3,995,561 A | | 12/1976 | Allor, Jr. | |
| 4,016,818 A | * | 4/1977 | Ellzey | 104/130.01 |
| 4,312,276 A | * | 1/1982 | Cory et al. | 104/130.01 |
| 4,381,478 A | | 4/1983 | Saijo et al. | |
| 4,463,300 A | | 7/1984 | Mayne et al. | |
| 4,542,698 A | | 9/1985 | Wakabayashi | |
| 4,590,411 A | | 5/1986 | Kelly | |
| 4,677,354 A | | 6/1987 | Pascal et al. | |
| 4,700,119 A | | 10/1987 | Karita | |
| 4,704,568 A | | 11/1987 | Beck et al. | |
| 4,772,837 A | | 9/1988 | MacMunn | |
| 4,890,023 A | | 12/1989 | Hinds et al. | |
| 5,219,395 A | * | 6/1993 | Spieldiener et al. | 104/130.01 |
| 5,475,190 A | | 12/1995 | Smith et al. | |
| 5,547,151 A | * | 8/1996 | Giras et al. | 246/227 |
| 5,562,041 A | | 10/1996 | Ellens | |

FOREIGN PATENT DOCUMENTS

| | | |
|---|---|---|
| DE | 28 13 256 A1 | 12/1978 |
| DE | 295 10 718 U | 11/1995 |

OTHER PUBLICATIONS

Northern Magnetics Linear Motor Technology Manual; "Polynoid Linear Motor"; pp. 23 & 24.

* cited by examiner

*Primary Examiner*—S. Joseph Morano
*Assistant Examiner*—Lars A. Olson
(74) *Attorney, Agent, or Firm*—Dickinson Wright PLLC

(57) ABSTRACT

A conveyor switch for a conveyor track comprising a tubular linear induction motor as the switch drive. A switch tongue is adapted to be pivoted between first and second positions on the conveyor track and has a driving arm extending from one end thereof. The switch drive is operatively connected to the driving arm for driving the switch tongue, wherein the switch tongue is adapted to direct a moving conveyor component between first and second paths of travel on the conveyor track. Various means are provided to account for the linear movement of the switch drive in relation to the arcuate movement of the switch tongue. The switch assembly is especially adapted for switches in power and free conveyor systems.

21 Claims, 5 Drawing Sheets

PLAN VIEW
(a)

SIDE VIEW
(b)

PLAN VIEW
(a)

SIDE VIEW
(b)

FRONT VIEW
(c)

PLAN VIEW
(a)

SIDE VIEW
(b)

PLAN VIEW
(a)

SIDE VIEW
(b)

FRONT VIEW
(c)

CONVEYOR SYSTEM SWITCH USING TUBULAR LINEAR INDUCTION MOTOR

RELATED APPLICATIONS

The present application claims priority from U.S. Provisional Application Ser. No. 60/132,802, which was filed on May 6, 1999, and which is incorporated herein by reference.

FIELD OF THE INVENTION

The present invention is directed to a conveyor system switch for control of conveyor travel between two travel paths, and, in particular, to a switch that employs a tubular linear induction motor for driving of the switch mechanism.

BACKGROUND OF THE INVENTION

Conveyor systems, such as power and free systems, typically have multiple tracks that are connected to each other, wherein a switch plate is employed that travels between first and second positions for directing a conveyed article from one track to another. Switch plates typically comprise a pivoting switch member having upper and lower tongues on one end, and a driving arm on the other end, wherein the upper and lower tongues are adapted to abut upper and lower track flanges to cause the article to be diverted to the appropriate track. In this manner, the switch plate functions to move between first and second positions, to divert the article being conveyed from one path to another, similar to a switch on a railroad track.

Various types of conveyor switches, like the one described above, have been used in past conveyor systems, including the one shown in U.S. Pat. No. 4,542,698. This patent discloses a switch powered by a hydraulic drive. One problem with prior systems of this type, however, is the complexity of the pipes, supply systems and compressors required for operation. Another problem is the high maintenance required to keep such systems in operation.

In view of the drawbacks of prior conveyor switches of the kind described above, a need has developed to provide an improved switch. The present invention solves the above problems through the use of a tubular linear induction motor as the switch drive. The present invention also contemplates using a mounting and/or connecting means to account for the arcuate movement of the switch member as it pivots.

SUMMARY OF THE INVENTION

The present invention represents an improvement over previous conveyor switches, and in particular, conveyor switches such as those that direct a moving conveyor component between two paths of travel, the switch including a switch tongue driven between first and second positions by a switch drive. Like previous conveyor switches, the present invention functions to divert conveyor components, such as trolleys, to one of two paths, wherein a pivoting switch member having upper and lower tongue members for engaging upper and lower track flanges are provided to cause the conveyor components to be diverted.

In one aspect, the present invention represents an improvement over previous switch designs in that it comprises a tubular linear induction motor as the switch drive for moving the switch member between the first and second positions. The linear induction motor preferably comprises a stationary primary, which can be provided with fins for better heat dissipation, and a moving secondary, such as a metal rod, extending linearly within the stationary primary. In this respect, the linear motion of the rod through the primary, from a retracted position to an extended position, and vice verse, is preferably induced by a sweeping magnetic field along the length of the primary, wherein the magnetic field interacts with currents induced within the secondary to provide a driving force to the rod. By reversing the sweep of the field, the travel direction of the rod can be reversed. The linear induction motor has fewer moving parts, is easier to maintain, and avoids the need for complicated hydraulic or pneumatic pipe systems.

The induction motor of the present invention can also be provided with one or more holding coils that can be employed to retain the secondary in a given position. For example, a holding coil can be employed on one side of the primary to maintain the secondary in the extended position, wherein the tongue members would then be positioned to cause the article to travel along one path. Another holding coil can also be provided on the other side of the primary to maintain the tongue members in the retracted position, wherein the tongue members would then cause the article to travel along the other path. The holding coils make it possible so that the induction motor does not have to be continually powered. By powering the motor for only a short period of time, motor life is increased and motor heat generation is minimized. The switch member can also include control components to interface the switch with other components of the conveyor system and their respective control features.

The switch member of the present invention preferably pivots about a single point. Therefore, the link between the switch member and its drive mechanism travels along an arcuate path, which is in contrast to the linear movement of the drive rod traveling between the extended and retracted positions. In this respect, the inventive switch is preferably adapted so that the arcuate movement of the link is accounted for by one of several mounting and/or connecting means, wherein side loading of the drive rod (which can cause abnormal wear to occur as the switch is repeatedly activated) can be avoided.

In one embodiment, the switch motor is allowed to rotate as the drive rod moves between the extended and retracted positions. In this respect, the motor is preferably mounted on a plate having a pivot pin extending therefrom, wherein the pivot pin is connected to a mounting frame with a low friction slide plate extending therebetween. In this embodiment, the pivot pin preferably has its vertical axis extending through the center of the drive rod, such that no eccentricity is created between the pivot pin and rod when the motor is rotated.

In another embodiment, the switch motor is mounted on a vertical trunnion with pivot pins extending above and below the motor to allow the motor to rotate. The entire motor with the trunnion tube is allowed to rotate in response to the switch member's arcuate movements. The pivot pins in this embodiment also have their vertical axis extending through the center of the drive rod for similar reasons.

In another embodiment, the drive rod is provided with a coupling that allows the distal end of the rod to move freely in relation to the remainder of the rod. In this respect, the coupling is capable of separating the movement of the link from the rod, such that while the portion of the drive rod within the primary moves linearly, the end of the rod connected to the link can move along an arcuate path.

In another embodiment, the switch motor is mounted onto a mounting frame, and a guide bar is provided to maintain the drive rod along a linear path. The connection between the drive rod and switch member is preferably provided with a slotted groove, to allow the link to move in relation to the rod, such that the link can follow an arcuate path, while the rod follows a linear path.

The four embodiments discussed above are examples of how the arcuate movements of the link can be accounted for by the present invention. Other ways, not mentioned herein, which provide similar functions, are also within the contemplation of the present invention.

DETAILED DESCRIPTION OF THE INVENTION

Figure 1:
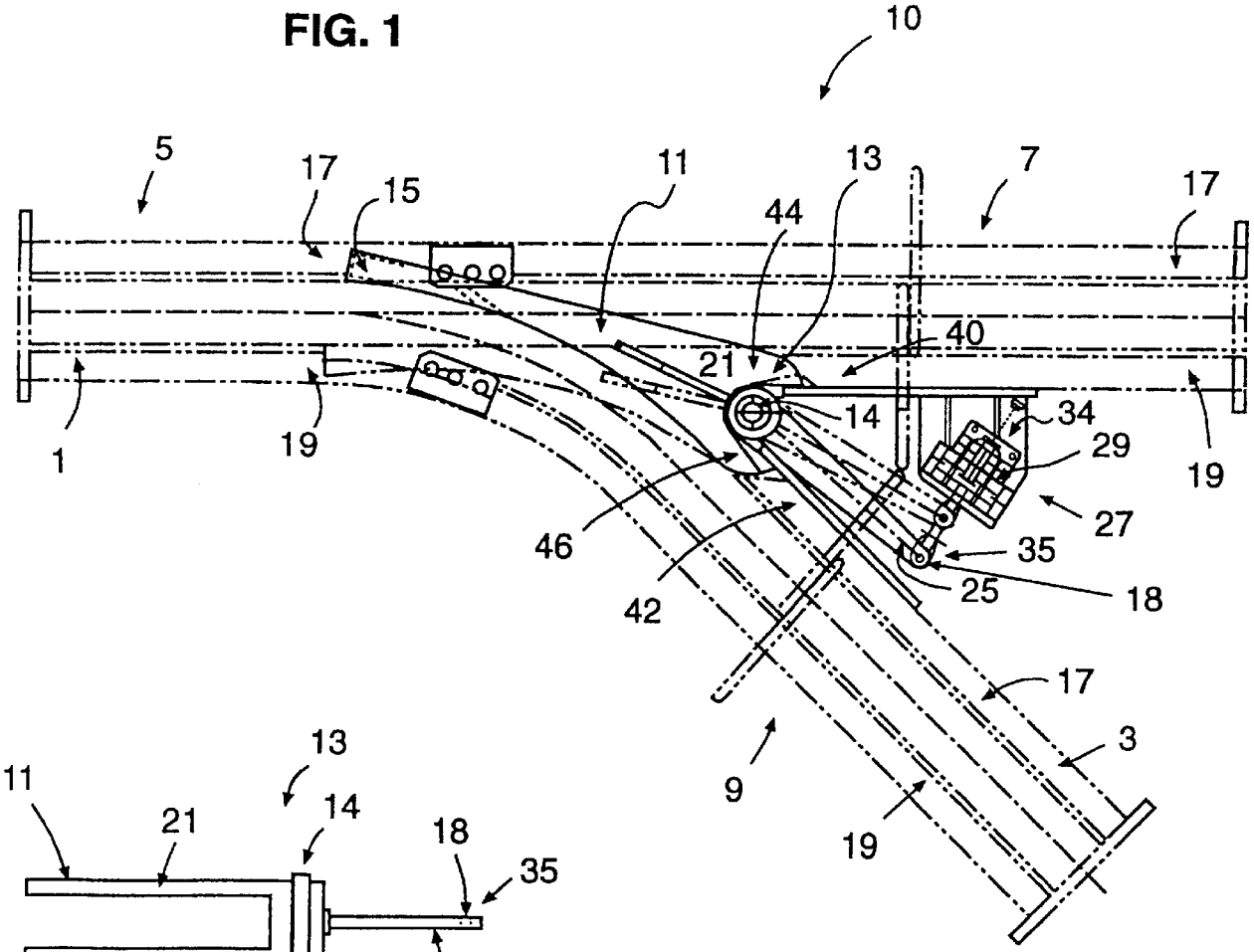
FIG. 1 shows a layout of the conveyor tracks and the switch member and motor of the present invention.

FIG. 1 shows a switch assembly 10 for an inverted power and free system illustrating one embodiment of the invention. In general, these systems comprise a power track and a free track. A chain travels in the power track and trolleys supporting a conveyed article, e.g., a skid or carrier for an automobile body, etc., travel in the free track. The chain is driven by a drive, the chain, in turn, driving the trolleys via a chain dog. Power and free conveyor systems are well known in the art and a detailed description thereof is not deemed necessary for understanding of the invention. While the inventive switch is exemplified for an inverted power and free system, it should be understood that the present invention is not limited to use with such systems. Overhead power and free systems can also utilize the switch, as can other conveyor systems, whereby a conveyor component travels in a path, e.g., a track, or the like, and requires redirection to another path or track.

FIG. 1 shows an embodiment with a first track 1 that extends substantially linearly, and a second track 3 connected and extending tangentially to the first track 1. Tracks 1 and 3 define three paths of travel. The first path, 5, extends along track 1, and is oriented left of the switch assembly 10. This is the path on which the conveyed article travels before reaching and being diverted by switch assembly 10. The second path, 7, also extends along track 1, but is oriented right of the switch assembly 10. This is the path taken by the conveyed article after the switch assembly 10 has been moved to the position shown in cross hatch in FIG. 1. The third path, 9, extends along track 3, and is oriented right of the switch assembly 10. This is the path taken by the conveyed article after the switch assembly 10 has been moved to the position shown in solid lines in FIG. 1.

The tracks 1 and 3 themselves are preferably conventional in design and preferably comprise two channel-like structures, 17, 19, positioned on their sides, with their openings facing each other. In this way, trolleys having rollers are preferably supported by and travel within the spaces between the opposing channels 17, 19, i.e., along the free track. At the intersection of tracks 1 and 3, flange 40 of channel 19 (of track 1) and flange 42 of channel 17 (of track 3) are preferably cut away 44, 46 to allow trolleys traveling along the first path 5 to be diverted to either second path 7, or third path 9. The cut-away areas 44, 46 of flanges 40, 42 allow the trolleys to travel past the intersection, to either path, as determined by switch assembly 10. Again, this is merely an example of a track system on which the present invention can be used.

The switch assembly 10 comprises a switch tongue 11 having an upper tongue portion 21 and a lower tongue portion 22. These tongue portions 21, 22 are adapted to abut the upper and lower flanges of channels 17 and 19 on track 1, along the first path 5, to replace the cut-away areas 44 or 46, such that when trolleys reach the switch assembly 10 they are diverted by tongue portions 21, 22 to either the second path 7, or third path 9, depending on which position the switch assembly 10 occupies. As indicated above, when switch assembly 10 is in the position shown in solid lines, the trolleys automatically divert to the third path 9. And when the switch assembly 10 is in the position shown in cross hatch, the trolleys automatically divert to the second path 7.

Figure 2:
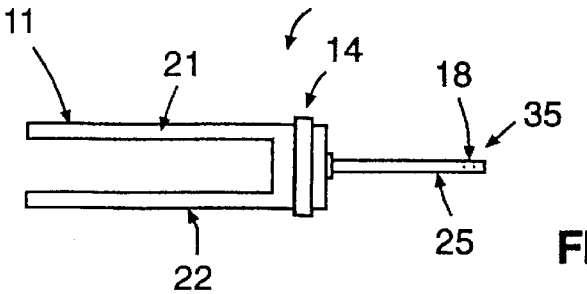
FIG. 2 shows a side view of the switch assembly of FIG. 1 removed from the conveyor tracks to show greater detail.

The switch tongue 11 is part of an overall switch member 13, shown in FIG. 2, capable of being pivotally mounted on pivot point 14. The switch member 13 is preferably secured such that it pivots along substantially a horizontal plane. This ensures that tongue portions 21 and 22 properly abut the appropriate channel flanges to enable the trolleys to be properly diverted. On the other end of switch member 13, extending away from switch tongue 11, i.e., on the other side of pivot point 14, is an extended drive arm 25 that acts as a moment arm to enable switch member 13 to be rotated. Preferably, a distal end 35 of drive arm 25 extends a predetermined distance from pivot point 14, such that the moment arm can easily rotate the switch member 13 when a force is applied.

Figure 3:
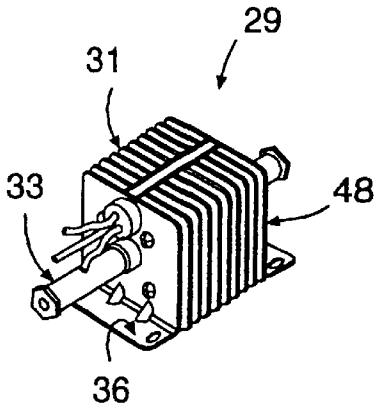
FIG. 3 shows the tubular linear induction motor of FIG. 1 in greater perspective detail.

The distal end 35 of drive arm 25 is preferably linked to drive assembly 27 to drive the movement of switch member 13. Preferably, the drive assembly 27 comprises a tubular linear induction motor 29, as shown in FIG. 3, which acts as the switch drive for moving the switch member 13 between the first and second positions. The linear induction motor 29 comprises a stationary primary 31 and a moving secondary 33. The stationary primary 31 is preferably made of a series of interconnected coils housed in an assembly, such as one made of cold-rolled steel, wherein the motor coils are wound on bobbins. The stationary primary 31 can be provided with fins 48 for better heat dissipation if desired. The moving secondary 33 can be a metal rod, such as made of copper-clad steel, and is preferably extended linearly within the primary 31, and is capable of being moved therein.

The tubular linear induction motor 29 preferably operates under the principles of electromagnetic induction. Linear motion of the moving secondary 33, between an extended position and a retracted position, is induced by a sweeping magnetic field along the length of the coils. The magnetic field interacts with currents induced within the secondary 33 to provide a driving force thereto. Reversing the sweep of the field reverses the travel direction of the secondary 33. The secondary 33 is preferably moved relatively quickly, quietly and powerfully between the retracted and extended positions, upon activation of the motor 29, using any type of conventional control connected to the motor.

The moving secondary 33 is preferably operatively attached to the distal end 35 of drive arm 25 by a link 18 (and clevis 61 as shown in FIGS. 4–7). Accordingly, by activating motor 29 and causing the secondary 33 to move linearly within the primary 31, between the extended and retracted positions, the switch member 13 is moved from first position to a second position, and vice verse. In this way, the switch member 13 can be used to divert the conveyor component, such that it follows either the second path 7, or third path 9, as determined by the switch. As shown in FIG. 1, with secondary 33 in the extended position, the switch member 13 allows for travel of the conveyor component, e.g., a trolley, along the first 5 and third 9 paths. Retracting the moving secondary 33 into the stationary primary 31, however, allows for travel of the conveyor component along the first 5 and second 7 paths.

The tubular induction motor 29 can be provided with one or more holding coils that can be employed to retain the secondary 33 in a given position. For example, a holding coil can be employed on one side of the primary 31 to maintain the secondary 33 in the extended position, wherein, in the embodiment shown, the tongue members 21, 22 would be maintained in the first position (shown in solid lines) to cause the article to travel along the third path 9 shown in FIG. 1. Another holding coil can also be provided on the other side of the primary 31 to maintain the tongue members 21, 22 in the retracted position, wherein the tongue members 21, 22 would then be maintained in the second position (shown in cross hatch) to cause the article to travel along the second path 7 shown in FIG. 1. Since the moving secondary 33 can be extended or retracted upon activation of the motor 29, the holding coils make it possible so that the induction motor does not have to be continually powered to retain the secondary 33 in a given position. By powering the motor for only a short period of time, motor life is increased and motor heat generation is minimized.

Because the switch member 13 of the present invention pivots about a single point 14, and moves along a horizontal plane, the link 18 between the switch member 13 and its drive mechanism 27 travels along an "arcuate" path, as shown in FIGS. 4–7. On the other hand, the switch drive, which in this case is the linear induction motor 29, comprises a drive rod 33 that travels "linearly" between the extended and retracted positions. For this reason, the present invention is preferably adapted so that the arcuate movement of the link 18 (connecting the drive rod 33 to switch member 13) is accounted for by one of several mounting and/or connecting means. In this respect, the present invention is preferably adapted to take into account the different ways in which the switch member 13 and drive rod 33 move, such that side loading of the drive rod 33 (which can cause abnormal wear to occur) can be avoided.

Figure 4:
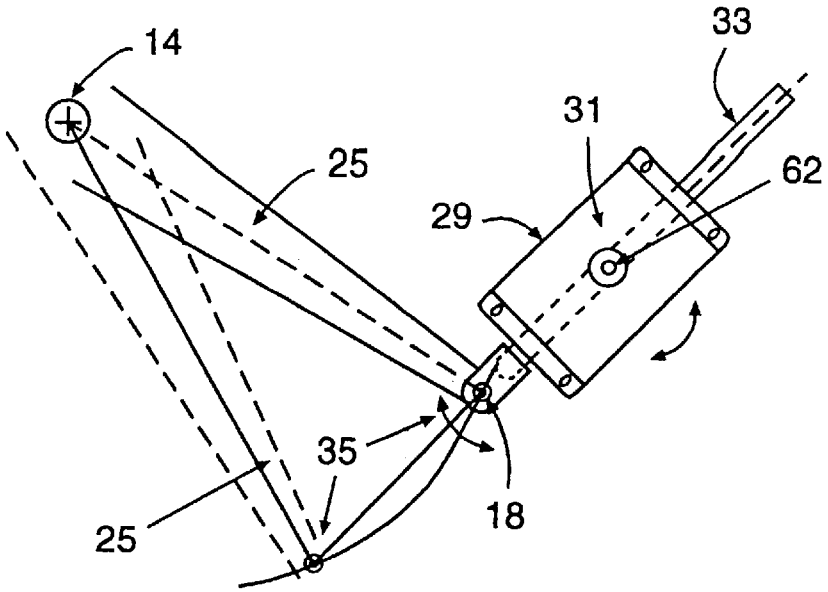
FIGS. 4(*a*) and (*b*) show a plan view and side view, respectively, of a first mounting embodiment of the present invention for accommodating the arcuate movement of the switch member.
Figure 4:
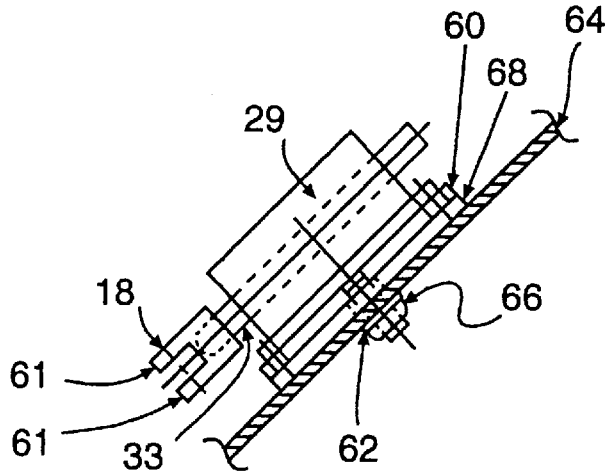

In the first mounting embodiment shown in FIGS. 4(*a*) and (*b*), the switch motor 29 is pivotally mounted so that the entire motor 29 is allowed to rotate as the drive rod 33 moves between the extended and retracted positions. The motor 29 is preferably mounted directly on a plate 60, such as one made of steel, and a pivot stud 62 preferably extends downwardly therefrom, wherein the pivot stud 62 is then rotatably connected to a mounting frame 64, preferably using a lock nut and washer with a nylon insert 66. A low friction slide plate 68, such as one made of UHMW, also preferably extends between the plate 60 and frame 64, to enable the surfaces to slide in relation to each other. In this embodiment, the pivot stud 62 preferably has its vertical axis extending upward through the center of the drive rod 33, wherein no eccentricity would then be created between the pivot stud 62 and drive rod 33 when the motor 29 is rotated. The link 18 is also preferably extended along a vertical axis and rotatably positioned within the clevis 61 extending from rod 33 to allow the distal end 35 of drive arm 25 to rotate (along a horizontal plane) in relation to drive rod 33.

Figure 5:
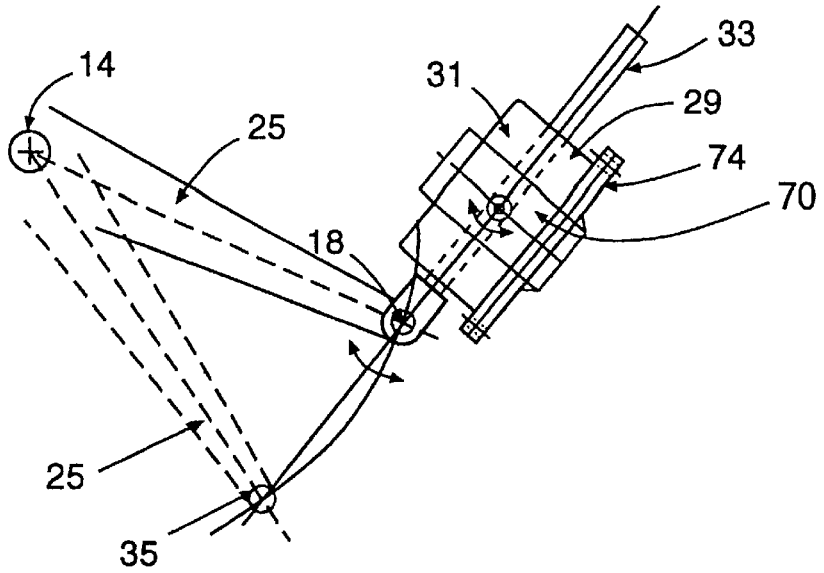
FIGS. 5(*a*), (*b*), and (*c*) show a plan view, side view and front view, respectively, of a second mounting embodiment of the present invention for accommodating the arcuate movement of the switch member.
Figure 5:
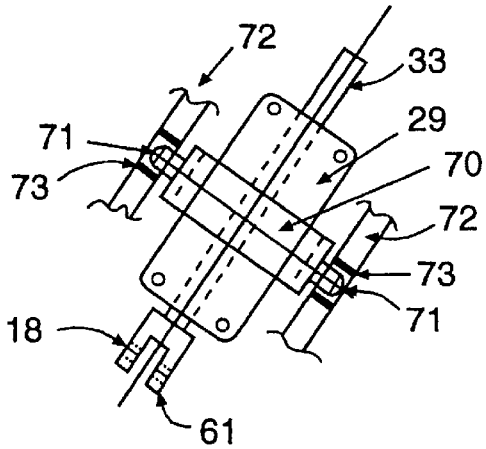
Figure 5:
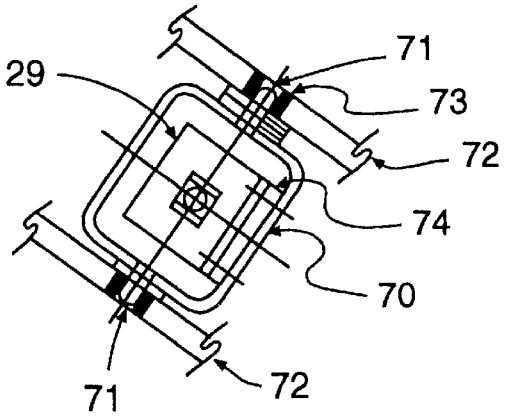

In the second mounting embodiment shown in FIGS. 5(*a*), (*b*), and (*c*), the switch motor 29 is mounted on a trunnion tube 70 with trunnion pins 71 extending above and below the tube 70 to allow the motor 29 to rotate. The trunnion pins 71 are pivotally mounted to mounting frames 72 above and below the motor 29 using pivot bushings 73. The motor 29 is preferably secured inside the trunnion tube 70 via a mounting plate 74, and the entire motor 29 (with the trunnion tube 70 around it) is allowed to rotate in response to the link's movement along the arcuate path shown in FIG. 5. The trunnion pins 71 in this embodiment also preferably have their vertical axis extending through the center of the drive rod 33, and link 18 is also extended along a vertical axis to allow the distal end 35 of drive arm 25 to rotate in relation to drive rod 33.

Figure 6:
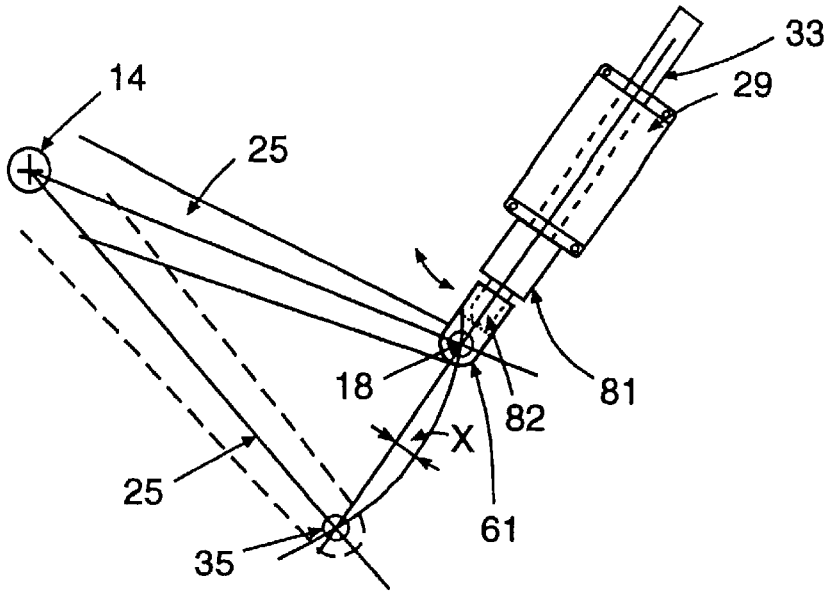
FIGS. 6(*a*) and (*b*) show a plan view and side view, respectively, of a third mounting embodiment of the present invention for accommodating the arcuate movement of the switch member.
Figure 6:
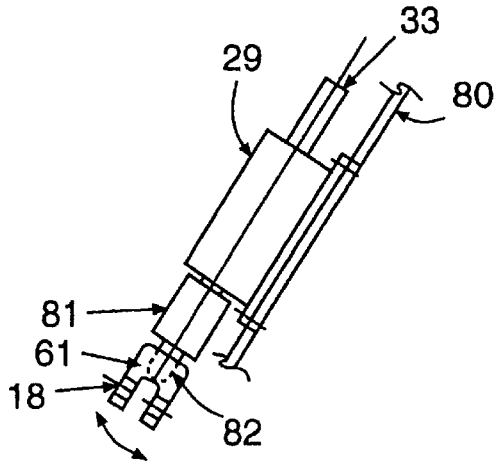

In the third embodiment shown in FIGS. 6(*a*) and (*b*), the switch motor 29 is mounted directly onto a mounting frame 80, but the drive rod 33 is provided with a coupling 81 that extends near its distal end 82 (which is connected to link 18). The coupling 81 is preferably what is often referred to as a misalignment coupling which allows for a predetermined degree of movement between one member (to which it is connected on one end), and a second member (to which it is connected on the other end). In this case, coupling 81 is connected between distal end 82 of drive rod 33 and the base of drive rod 33, such that distal end 82 can operatively move in relation to the base. Coupling 81 is capable of allowing link 18 to move in relation to drive rod 33, such that the base portion of drive rod 33 can be moved linearly, while the distal end 82 can be moved along an arcuate path.

The degree to which coupling 81 is allowed to move along a horizontal plane depends on the length of the drive arm 25 (i.e., the radius of the arcuate path), and the degree to which the switch member 13 pivots along a horizontal plane. The distance "x," shown in FIG. 6 (*a*), is the distance that link 18 must move "out-of-linear" (in relation to the linear path of rod 33), as switch member 13 travels along the arcuate path, which must be accounted for by coupling 81. That is, distance x is the distance that must be allowed by coupling 81 during each stroke, to accommodate the arcuate movement of switch member 13. The preferred coupling 81 also allows the distal end 82 to move in all directions to some degree, including vertically.

Figure 7:
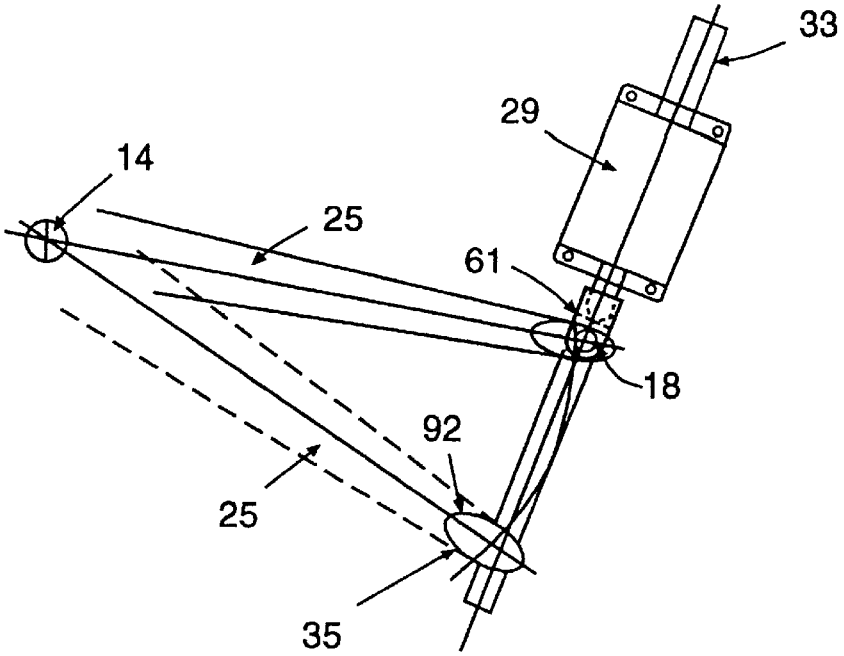
FIGS. 7(*a*), (*b*), and (*c*) show a plan view, side view and front view, respectively, of a fourth mounting embodiment of the present invention for accommodating the arcuate movement of the switch member.
Figure 7:
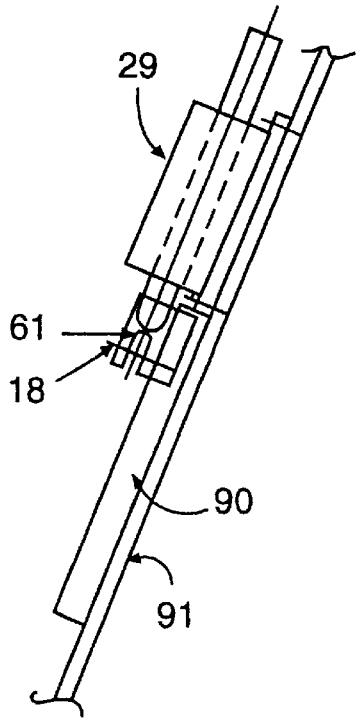
Figure 7:
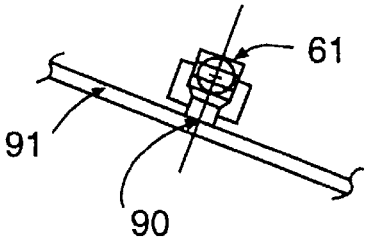

In the fourth embodiment shown in FIGS. 7(*a*), (*b*), and (*c*), the switch motor 29 is mounted onto a mounting frame 91, and the drive rod 33 is maintained in a linear path by a guide bar 90 that is mounted to and extends upwardly from the mounting frame 91. The guide bar 90 is preferably formed like any type of conventional track that extends linearly in relation to the rod. The clevis 61 in this embodiment is preferably adapted so that it is guided by guide bar 90 in a linear direction, between the retracted and extended positions. In this embodiment, link 18 preferably has a slotted groove 92 on the distal end 35 of drive arm 25 to allow link 18 to move "out-of-linear" in relation to the linear path of rod 33 (as the rod travels between the retracted and extended positions). The groove 92 is preferably large enough to enable link 18 to travel a distance sufficient to allow link 18 to follow the arcuate path, while rod 33 follows a linear path along guide bar 90.

These embodiments represent exemplary ways in which the present invention can account for the arcuate movement of switch member 13. It should be understood, nevertheless, that other ways are possible, that are not specifically disclosed herein, which provide similar functions, and are within the scope of the present invention.

The switch of the present invention offers significant improvements to existing switches for conveyor systems, particularly those employing pneumatic or hydraulic components. First, the necessity for complicated air and water systems is eliminated. Second, an electrically powered actuator, such as the motor of the present invention, is ideally suited to many conveyor systems, since the systems themselves are typically electrically powered (and not pneumatically or hydraulically powered). Third, using a tubular linear induction motor eliminates the need for components to convert an electric motor's rotary motion to a linear motion. Fourth, the motor 29 has no moving parts other than the secondary 33 so maintenance requirements are reduced. Fifth, the motor 29 is relatively quiet during operation (verses pneumatic actuators that are relatively noisy). Sixth, the holding coils can lock the secondary 33 in a given position without having to expend power to hold them in place. Seventh, the linear movements of the secondary 33 in relation to the arcuate movements of the switch member 13 will not result in side loading of the secondary.

The invention provides a new and improved conveyor switch and has been disclosed in terms of the preferred embodiments thereof. Nevertheless, various changes, modifications and alterations from the teachings of the present invention may be contemplated by those skilled in the art without departing from the intended scope of the invention.

What is claimed is:

1. A method of directing a moving conveyor component between first and second paths of travel, comprising:

activating an electromagnetic field within a linear induction motor having a stationary primary and a moving secondary;

causing said field to move linearly along said stationary primary and to interact with currents induced within said moving secondary;

moving said moving secondary in a linear direction in relation to said stationary primary, between an extended position and a retracted position, wherein said moving secondary is physically linked to a drive arm extending from a switch member for moving said conveyor component;

driving said switch member between first and second positions using said linear induction motor physically linked to said switch member;

causing said conveyor component to be switched between said first and second paths of travel by said switch member, wherein the link between said drive arm and said moving secondary is adapted such that the arcuate movement of said switch member about a pivot point in relation to said linear movement of said moving secondary is accommodated thereby; and selectively energizing a holding coil mounted adjacent said stationary primary of said motor, and retaining said moving secondary in said extended or retracted position.

2. The method of claim 1, further comprising allowing said linear induction motor to rotate to accommodate the linear movement of said moving secondary in relation to the arcuate movement of said switch member.

3. The method of claim 1, further comprising allowing said linear induction motor to rotate by connecting said motor to a trunnion having first and second pivot pins, wherein the linear movement of said moving secondary in relation to the arcuate movement of said switch member can be accommodated thereby.

4. The method of claim 1, further comprising allowing said moving secondary to pivot in relation to said drive arm via a coupling located on said moving secondary, wherein the linear movement of said moving secondary in relation to the arcuate movement of said switch member can be accommodated thereby.

5. The method of claim 1, further comprising causing said moving secondary to move linearly along a guide bar, and allowing said moving secondary to move in relation to said drive arm, such that the linear movement of said moving secondary in relation to the arcuate movement of said switch member can be accommodated thereby.

6. A conveyor switch for directing a moving conveyor component between two paths of travel, comprising:

a switch member adapted to be pivoted about a pivot point between first and second positions, said switch member having an engaging portion for engaging said conveyor component and a drive arm extending therefrom;

a linear induction motor for driving said switch member between said first and second positions, said linear induction motor comprising a stationary primary and a moving secondary adapted to move linearly between an extended position and a retracted position, and at least one holding coil capable of being selectively energized to retain said moving secondary in said extended or retracted position; and wherein said moving secondary is connected to said drive arm, and wherein said connection is adapted such that the arcuate movement of said switch member about said pivot point in relation to said linear movement of said moving secondary is accommodated thereby.

7. The switch of claim 6, wherein said motor is rotatably mounted, and the connection between said moving secondary and said drive arm pivots, such that the arcuate movement of said switch member in relation to said linear movement of said moving secondary is accommodated thereby.

8. The switch of claim 7, wherein said motor is rotatably mounted on a plate with a pivot pin having a vertical axis extending through the center of said moving secondary.

9. The switch of claim 6, wherein said motor is mounted on a rotatable trunnion, and the connection between said moving secondary and said drive arm pivots, such that the arcuate movement of said switch member in relation to said linear movement of said moving secondary is accommodated thereby.

10. The switch of claim 9, wherein said motor is mounted on a trunnion tube having two pivot pins extending upward and downward in relation to said motor, said pivot pins having a common vertical axis extending through the center of said moving secondary.

11. The switch of claim 6, wherein a movable coupling is provided on the connection between said moving secondary and said drive arm such that the arcuate movement of said switch member in relation to said linear movement of said moving secondary is accommodated thereby.

12. The switch of claim 6, wherein a guide bar is provided to guide said moving secondary along a linear path, and wherein the connection between said moving secondary and said drive arm enables said moving secondary to move in relation to said drive arm, such that the arcuate movement of said switch member in relation to said linear movement of said moving secondary is accommodated thereby.

13. A conveyor switch for directing a moving conveyor component between two paths of travel, comprising:

a pivoting switch member adapted to be moved between first and second positions, said switch member having an engaging portion for engaging said conveyor component and a drive arm extending therefrom;

a linear induction motor for driving said switch member between said first and second positions, said linear induction motor comprising a stationary primary and a moving secondary adapted to move linearly within said primary, wherein said moving secondary is adapted to move between an extended position and a retracted position, and is connected to said drive arm in a manner which drives said switch member between said first and second positions, while accommodating the linear movement of said moving secondary in relation to the arcuate movement of said pivoting switch member, and said motor has at least one holding coil capable of being selectively energized to retain said moving secondary in said extended or retracted positions.

14. The switch of claim 13, wherein said drive arm moves along an arcuate path between said first and second positions, and wherein said motor is rotatably mounted to accommodate the arcuate movement of said drive arm in relation to said linear movement of said moving secondary.

15. The switch of claim 13, wherein said drive arm moves along an arcuate path between said first and second positions, and wherein said motor is rotatably mounted on a trunnion to accommodate the arcuate movement of said drive arm in relation to said linear movement of said moving secondary.

16. The switch of claim 13, wherein said drive arm moves along an arcuate path between said first and second positions, and wherein a coupling is provided on the connection between said moving secondary and said drive arm to accommodate the arcuate movement of said drive arm in relation to said linear movement of said moving secondary.

17. The switch of claim 13, wherein said drive arm moves along an arcuate path between said first and second positions, and wherein a guide bar is provided to guide said moving secondary in said linear direction, wherein the connection between said drive arm and said moving secondary enables said moving secondary to move in relation to said drive arm to accommodate the arcuate movement of said drive arm in relation to said linear movement of said moving secondary.

18. A method of directing a moving conveyor component between first and second paths of travel, comprising:

activating an electromagnetic field within a linear induction motor having a stationary primary and a moving secondary;

causing said field to move linearly along said stationary primary and to interact with currents induced within said moving secondary;

moving said moving secondary in a linear direction in relation to said stationary primary, between an extended position and a retracted position, wherein said moving secondary is linked to a drive arm extending from a switch member for moving said conveyor component;

driving said switch member between first and second positions using said linear induction motor physically linked to said switch member;

causing said conveyor component to be switched between said first and second paths of travel by said switch member, without the link having to resist the conveyor component, wherein the link between said drive arm and said moving secondary is adapted such that the arcuate movement of said switch member about a pivot point in relation to said linear movement of said moving secondary is accommodated thereby; and causing said moving secondary to move linearly along a guide bar, and allowing said moving secondary to move along a slot in relation to said drive arm, such that the linear movement of said moving secondary in relation to the arcuate movement of said switch member can be accommodated thereby.

19. A conveyor switch for directing a moving conveyor component between two paths of travel, comprising:

a switch member adapted to be pivoted about a pivot point between first and second positions, said switch member having an engaging portion for engaging said conveyor component and a drive arm extending therefrom;

a linear induction motor for driving said switch member between said first and second positions, said linear induction motor comprising a stationary primary and a moving secondary adapted to move linearly between an extended position and a retracted position;

wherein said moving secondary is connected to said drive arm, and wherein said connection is adapted such that the arcuate movement of said switch member about said pivot point in relation to said linear movement of said moving secondary is accommodated thereby; and wherein a guide bar is provided to guide said moving secondary along a linear path, and wherein the connection between said moving secondary and said drive arm comprises a slot that enables said moving secondary to move in relation to said drive arm, such that the arcuate movement of said switch member in relation to said linear movement of said moving secondary is accommodated thereby.

20. A conveyor switch for directing a moving conveyor component between two paths of travel, comprising:

a pivoting switch member adapted to be moved between first and second positions, said switch member having an engaging portion for engaging said conveyor component and a drive arm extending therefrom;

a linear induction motor for driving said switch member between said first and second positions, said linear induction motor comprising a stationary primary and a moving secondary adapted to move linearly within said primary, wherein said moving secondary is adapted to move between an extended position and a retracted position, and is connected to said drive arm in a manner which drives said switch member between said first and second positions without having to resist the conveyor component, while accommodating the linear movement of said moving secondary in relation to the arcuate movement of said pivoting switch member; and wherein said drive arm moves along an arcuate path between said first and second positions, and wherein a guide bar is provided to guide said moving secondary in said linear direction, wherein the connection between said drive arm and said moving secondary is slotted to enable said moving secondary to move in relation to said drive arm to accommodate the arcuate movement of said drive arm in relation to said linear movement of said moving secondary.

21. A conveyor switch for directing a moving conveyor component between two paths of travel, comprising:

a pivoting switch member adapted to be moved between first and second positions, said switch member having an engaging portion for engaging said conveyor component and a drive arm extending therefrom;

a linear induction motor for driving said switch member between said first and second positions, said linear induction motor comprising a stationary primary and a moving secondary adapted to move linearly within said primary between an extended position and a retracted position, and is connected to said drive arm in a manner which drives said switch member between said first and second positions, while accommodating the linear movement of said moving secondary in relation to the arcuate movement of said pivoting switch member; and wherein said motor is mounted on a rotatable trunnion tube having two pivot pins extending upward and downward in relation to said motor, said pivot pins having a common vertical axis extending through the center of said moving secondary and being connected to upper and lower mounting frames to enable said tube to pivot, and wherein the connection between said moving secondary and said drive arm pivots, such that the arcuate movement of said switch member in relation to said linear movement of said moving secondary is accommodated thereby.

* * * * *